US011422579B2

(12) United States Patent
Sankman et al.

(10) Patent No.: US 11,422,579 B2
(45) Date of Patent: Aug. 23, 2022

(54) LOW DROPOUT CONTROL FOR LIGHT LOAD QUIESCENT CURRENT REDUCTION

(71) Applicant: TEXAS INSTRUMENTS INCORPORATED, Dallas, TX (US)

(72) Inventors: Joseph Alan Sankman, Dallas, TX (US); Abhiram Mumma Reddy, Tucson, AZ (US); Kishan Joshi, Tucson, AZ (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 16/794,133

(22) Filed: Feb. 18, 2020

(65) Prior Publication Data

US 2020/0278710 A1 Sep. 3, 2020

Related U.S. Application Data

(60) Provisional application No. 62/812,715, filed on Mar. 1, 2019.

(51) Int. Cl.
*G05F 1/575* (2006.01)
*G05F 1/595* (2006.01)

(52) U.S. Cl.
CPC ..... *G05F 1/575* (2013.01); *G05F 1/595* (2013.01)

(58) Field of Classification Search
CPC ..... G05F 1/565; G05F 1/575; G05F 1/595
See application file for complete search history.

(56) References Cited

U.S. PATENT DOCUMENTS

2009/0128107 A1* 5/2009 Wang ..... G05F 1/575 323/280
2014/0375250 A1* 12/2014 Li ..... H02J 7/0072 320/107
2017/0220058 A1* 8/2017 Petenyi ..... G05F 1/575
2018/0017984 A1* 1/2018 Mayer ..... G05F 1/575
2020/0059165 A1* 2/2020 Xiao ..... H02M 7/06

OTHER PUBLICATIONS

Linear Technology, "60V 2MHz Synchronous 4-Switch Buck-Boost Controller With Spread Spectrum," LT8390A, 2017, 30 p.
Texas Instruments, "LM5176 55-V Wide Vin Synchronous 4-Switch Buck-Boost Controller," SNVSAI1A—Jun. 2017, revised Mar. 2019, 42 p.

(Continued)

*Primary Examiner* — Kyle J Moody
*Assistant Examiner* — Lakaisha Jackson
(74) *Attorney, Agent, or Firm* — Mark A. Valetti; Charles A. Brill; Frank D. Cimino

(57) ABSTRACT

Aspects of the disclosure provide for a circuit. In at least some examples, the circuit comprises a first amplifier, a voltage divider, a first resistor, and a transistor. The first amplifier comprises a first input terminal configured to receive a first voltage signal, a second input terminal coupled to a first node, and an output terminal. The voltage divider is coupled between a second node and a ground node and having the first node as an output node of the voltage divider. The first resistor is coupled at a first end to the second node. The transistor comprises a gate terminal coupled to the output terminal of the first amplifier, the transistor being coupled between an input voltage node and a second end of the first resistor.

16 Claims, 6 Drawing Sheets

(56) References Cited

OTHER PUBLICATIONS

Texas Instruments, "TPS5516x-Q1 36-V, 1-A Output, 2-MHz, Single Inductor, Synchronous Step-Up and Step-Down Voltage Regulator," SLVSD46, Nov. 2017, 45 p.
Texas Instruments, "TPS63802 2-A, High-Efficient, Low IQ Buck-Boost Converter in DFN Package," SLVSEU9B, Nov. 2018, revised Oct. 2019, 37 p.

* cited by examiner

LOW DROPOUT CONTROL FOR LIGHT LOAD QUIESCENT CURRENT REDUCTION

CROSS-REFERENCE TO RELATED APPLICATIONS

The present application claims priority to U.S. Provisional Patent Application No. 62/812,715, which was filed Mar. 1, 2019, is titled "Low Dropout Control For Light Load Quiescient Current Reduction," and is hereby incorporated herein by reference in its entirety.

BACKGROUND

A low dropout regulator (LDO) is a direct-current (DC) linear voltage regulator that regulates an output voltage (VOUT) based on an input voltage (VIN). When VIN is greater in value than a reference voltage (VREF) that indicates a desired regulation point for VOUT, the LDO regulates VIN down to generate VOUT. When VIN is less in value than VREF, the LDO enters dropout. When in dropout, current consumption of the LDO can increase substantially when compared to operation of the LDO when not in dropout. This increase in current consumption can be on the order of tens, hundreds, or thousands of times more current consumption by the LDO when in dropout than when not in dropout.

SUMMARY

Aspects of the disclosure provide for a circuit. In at least some examples, the circuit comprises a first amplifier, a voltage divider, a first resistor, and a transistor. The first amplifier comprises a first input terminal configured to receive a first voltage signal, a second input terminal coupled to a first node, and an output terminal. The voltage divider is coupled between a second node and a ground node and having the first node as an output node of the voltage divider. The first resistor is coupled at a first end to the second node. The transistor comprises a gate terminal coupled to the output terminal of the first amplifier, the transistor being coupled between an input voltage node and a second end of the first resistor.

Other aspects of the present disclosure provide for a circuit. In at least some examples, the circuit includes a low dropout regulator (LDO) and a minimum dropout voltage circuit. The LDO comprises a first input terminal configured to receive a reference voltage, a second input terminal coupled to an input voltage node and configured to receive an input voltage signal; and an output node. The minimum dropout voltage circuit comprises a first input terminal configured to receive a first voltage signal, a second input terminal coupled to the input voltage node, and an output terminal coupled to the second input terminal of the LDO. The minimum dropout voltage circuit is configured to prevent the LDO from entering dropout by maintaining a value of the reference voltage less than a value of the input voltage signal by a minimum dropout voltage.

Other aspects of the present disclosure provide for a system. In at least some examples, the system comprises a LDO, a sensor, and a minimum dropout voltage circuit. The LDO comprises a first input terminal configured to receive a reference voltage, a second input terminal coupled to an input voltage node and configured to receive an input voltage signal; and an output node. The sensor is coupled to the output node and configured to receive regulated power from the output node. The minimum dropout voltage circuit comprises a first input terminal configured to receive a first voltage signal, a second input terminal coupled to the input voltage node, and an output terminal coupled to the second input terminal of the LDO. The minimum dropout voltage circuit is configured to prevent the LDO from entering dropout by maintaining a value of the reference voltage less than a value of the input voltage signal by a minimum dropout voltage.

BRIEF DESCRIPTION OF THE DRAWINGS

For a detailed description of various examples, reference will now be made to the accompanying drawings in which.

DETAILED DESCRIPTION

Figure 1:
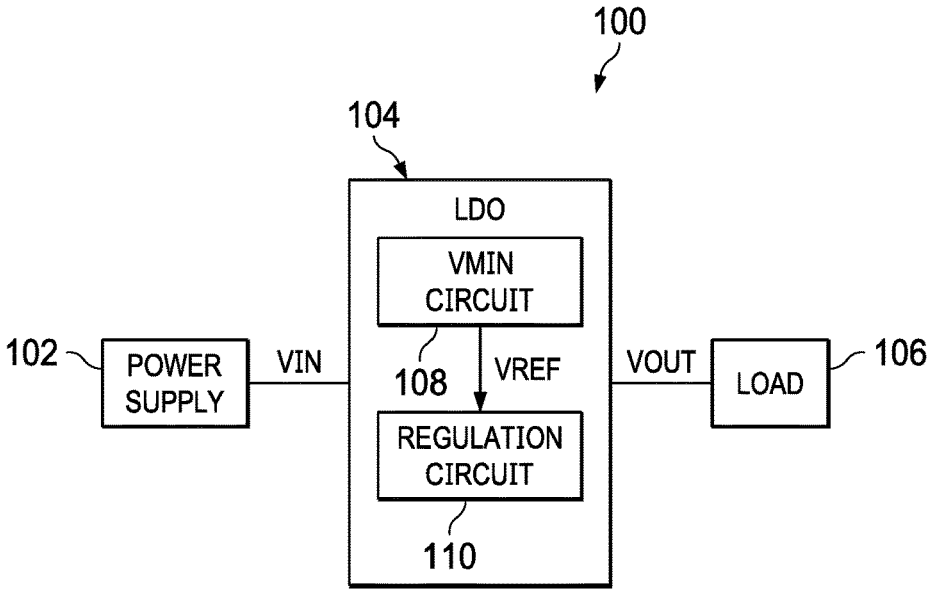
FIG. 1 shows a block diagram of an illustrative system in accordance with various examples.

A common problem that some low dropout regulator (LDO) topologies experience is operation in dropout. Dropout operation occurs when an input voltage (VIN) supplying the LDO decreases in value below a desired output voltage (VOUT). For example, if the LDO is set to regulate its output at 3.3 volts (V) and VIN is 3.8V, the LDO operates according to normal operation (e.g., regulates the 3.8V down to 3.3V). If VIN drops in value to 3V (e.g., if the input is a depletable source such as a battery), the LDO will try to pull VOUT up to 3.3V. However, because the 3V VIN itself is less than 3.3V and a LDO does not include circuitry for boosting voltages, the LDO will not be able to achieve a VOUT of 3.3V with a VIN of 3V. To the LDO, the error between an actual VOUT (e.g., about 3V) and the desired regulation voltage, represented by a reference voltage (VREF), appears the same as if there were a large load current creating a drop in VOUT from VREF, causing the LDO to attempt to source more current to increase the value of VOUT to meet VREF. However, this can happen when a small load current, or even no load current, is being drawn from the LDO.

In some LDO topologies, this results in a large increase in quiescent current (IQ). IQ is the current consumed by the LDO in regulating VOUT that is not current being passed to the load by the LDO. If there is no load drawing current from the LDO, or the load is drawing a very small amount of current (e.g., light load, such as a current draw having a value at least two orders of magnitude less than a maximum load current supported by the LDO), this results in a reduction in efficiency of the LDO. For example, the LDO may consume more current (e.g., the IQ current) than the LDO delivers to the load. In some LDO implementations, such as an ultra-low IQ LDO for which an IQ of 30 nanoamperes (nA) or less is desired, the increase in IQ experienced during dropout can be undesirable and render a LDO unsuitable for ultra-low IQ implementations. Particularly, when VIN is provided by a depletable voltage supply, such as a battery, the increased IQ drawn by the LDO in the attempt to regulate VOUT up to VREF significantly reduces a usable lifespan of the depletable voltage supply. For example, IQ of some LDO topologies in dropout can be tens, hundreds, or thousands of times the IQ of the LDO when not in dropout. This correspondingly reduces a usable lifespan of the depletable voltage supply by tens, hundreds, or thousands of times the usable lifespan when the LDO is not operating in dropout.

Some approaches exist to mitigate the increase in IQ when a LDO is in dropout. For example, an amplifier (such as a common-gate amplifier) may be implemented in a LDO to crush a common-source device to inhibit IQ from increasing to hundreds of microamperes (μA). Crushing the common-source device, in at least some examples, reduces a gate-to-source voltage (VGS) of the common-source device to a value so low that very little current flows through the common-source device (e.g., the common source device is operating in a triode region of operation). However, in at least some examples this approach only limits IQ to approximately 30 μA, which may still be orders of magnitude too large for at least some applications of an ultra-low IQ LDO. Moreover, the LDO is not in regulation, potentially resulting in overshoot of VOUT (increase in VOUT beyond VREF) if VIN suddenly increases in value (such as increases in value at a rate of about 1 V per microsecond or greater).

At least some aspects of the present disclosure provide for a LDO including a minimum dropout voltage (VMIN) circuit. Other aspects of the present disclosure provide for the VMIN circuit as a standalone circuit and not as an integrated component of the LDO. In at least one example, the VMIN circuit forces VREF to be approximately equal to VIN minus VMIN. In various examples, VMIN is generated according to varying processes. For example, in some implementations VMIN is a set value (e.g., a constant). In other examples, VMIN varies with temperature, VIN, process, or any other suitable variable. For example, in at least some examples, VMIN is generated by drawing a bias current (IB) through a resistor (RMIN) that is pulled up at a top node to VIN. A voltage dropped across RMIN is VMIN such that a voltage present at the bottom node of RMIN is VIN-VMIN, or VREF. In this configuration, by modifying a value of IB and/or a value of RMIN, VMIN is modified. Further, in this configuration, and without modifying a value of IB or a value of RMIN, VREF adapts to a change in VIN. Generally, VMIN is generated such that when the LDO is in dropout, VREF is maintained at a lower value than VIN. In this way, the LDO retains an ability to regulate VIN down to VREF, preventing dropout operation such that the LDO is not increasing IQ by trying to pull VOUT up to a value greater than VIN. In at least some examples, as VMIN increases in value, IQ will be further limited at heavier loads. However, also as VMIN increases, power dissipation by the LDO in the form of heat will increase, potentially offsetting at least some efficiency gains resulting from the increase in VMIN.

Turning now to FIG. 1, a block diagram of an illustrative system 100 is shown. The system 100 is generally representative of any device that implements a LDO to generate VOUT according to a received VIN. For example, in various implementations, the system 100 is representative of a consumer electronic device such as a wearable device, a smartphone, a portable computer, a tablet device, a camera, etc. In various other implementations, the system 100 is representative of an enterprise device such as a server computer, networking equipment, industrial machinery (e.g. robotic equipment), etc. In yet other implementations, the system 100 is representative of accessory type devices such as sensors, monitors, health devices, or other devices that may be battery operated and for which continued operation for an extended period of time without requiring a change of battery may be a desirable characteristic. Additionally, the teachings of the present disclosure are generally beneficial and/or advantageous in examples of the system 100 in which the creation of signal noise is undesirable and/or can corrupt meaningful or desired data. Examples of such systems can include smoke detectors, electronic meters (e-meters) such as for water, gas, or electricity readings, and portable health monitoring devices (e.g., heart rate monitors, oxygen monitors, blood sugar monitors, etc.), among other devices.

In at least one example, the system 100 includes a power supply 102, a LDO 104, and a load 106. The LDO 104, in at least some examples, includes a VMIN circuit 108 and a regulation circuit 110. In at least some implementations of the system 100, the power supply 102 is a depletable component, such as a non-rechargeable or rechargeable battery, a capacitor, or any other suitable component for which an output voltage decreases with use (e.g., as energy stored by the power supply 102 is depleted). In other examples, the power supply 102 is a non-depletable power supply (e.g., mains power or a signal derived from mains power) that may not deplete, but may temporarily decrease in value, such as due to loading. In various implementations, the load 106 takes any suitable form or forms. For example, the load 106 may be a single circuit or may be multiple circuits that receive VOUT from the LDO 104 and are illustrated collectively for the sake of clarity of description. In at least some examples, the load 106 is, or includes, a processing element (e.g., such as a processor, a microprocessing unit, a logic circuit, etc.), a sensor, a memory (e.g., data storage) device, a data input device, or a data output device (e.g., a visual and/or audible output device). In at least some examples, the power supply 102 is a switched mode power supply such that the LDO 104 filters an output of the switched mode power supply to generate VOUT, in some examples, reducing signal noise or smoothing the output of the switched mode power supply.

In at least one example of operation, the power supply 102 outputs VIN to the LDO 104. The LDO 104 in turn processes VIN to generate VOUT, which is output by the LDO 104 to the load 106. In at least some examples, the LDO 104 receives a bandgap voltage (VBG). In at least some examples, VBG is approximately equal to 1.2V. In other examples, VBG has any suitable value. Generally, VBG has a value less than VREF. In other examples, VBG is equal to VREF (e.g., VBG is used directly as VREF). The VMIN circuit 108 generates VREF, in some examples, according to VBG, and in other examples at least partially according to VIN. For example, when VIN is greater than VOUT, the VMIN circuit 108 generates VREF at least partially according to VBG and the regulation circuit 110 generates VOUT from VIN at least partially based on VREF. In this circumstance, VREF is approximately equal to a target VREF (VREF_TARGET), which represents a desired value for VOUT. When VIN is less than VOUT, the VMIN circuit 108 generates VREF at least partially according to VIN. In this way, as VIN drops in value, so too does VREF. Because VREF is dropping in value as VIN drops in value, when the regulation circuit 110 generates VOUT from VIN at least partially based on VREF, the decreasing value of VREF prevents the LDO 104 from entering dropout. In the circumstance in which VREF is generated at least partially according to VIN, VREF is less than the VREF_TARGET. For example, when VIN is 5V and VREF is 3.3V, the LDO regulates VOUT to maintain a value of approximately 3.3V. In this example, VREF_TARGET, or desired VOUT for the LDO 104, is 3.3V. When VIN drops to less than 3.3V, the VMIN circuit 108 in turn reduces the value of VREF to approximately VIN minus VMIN. In this case, while the LDO 104 still regulates the value of VOUT according to VREF, the VREF (approximately equal to VIN minus VMIN) is less than the VREF_TARGET of 3.3V. By regulating VOUT to VREF, despite VREF being less than the VREF_TARGET, the VMIN circuit 108 prevents the LDO 104 from entering dropout and experiencing a substantial increase in IQ, as could otherwise occur in the absence of the VMIN circuit 108.

In at least some examples, the regulation circuit 110 receives VREF from the VMIN circuit 108 and generates VOUT based on VIN and VREF. For example, the regulation circuit 110 controls one or more components to decrease a value of VIN to approximately equal VREF and output that resulting signal as VOUT.

Figure 2:
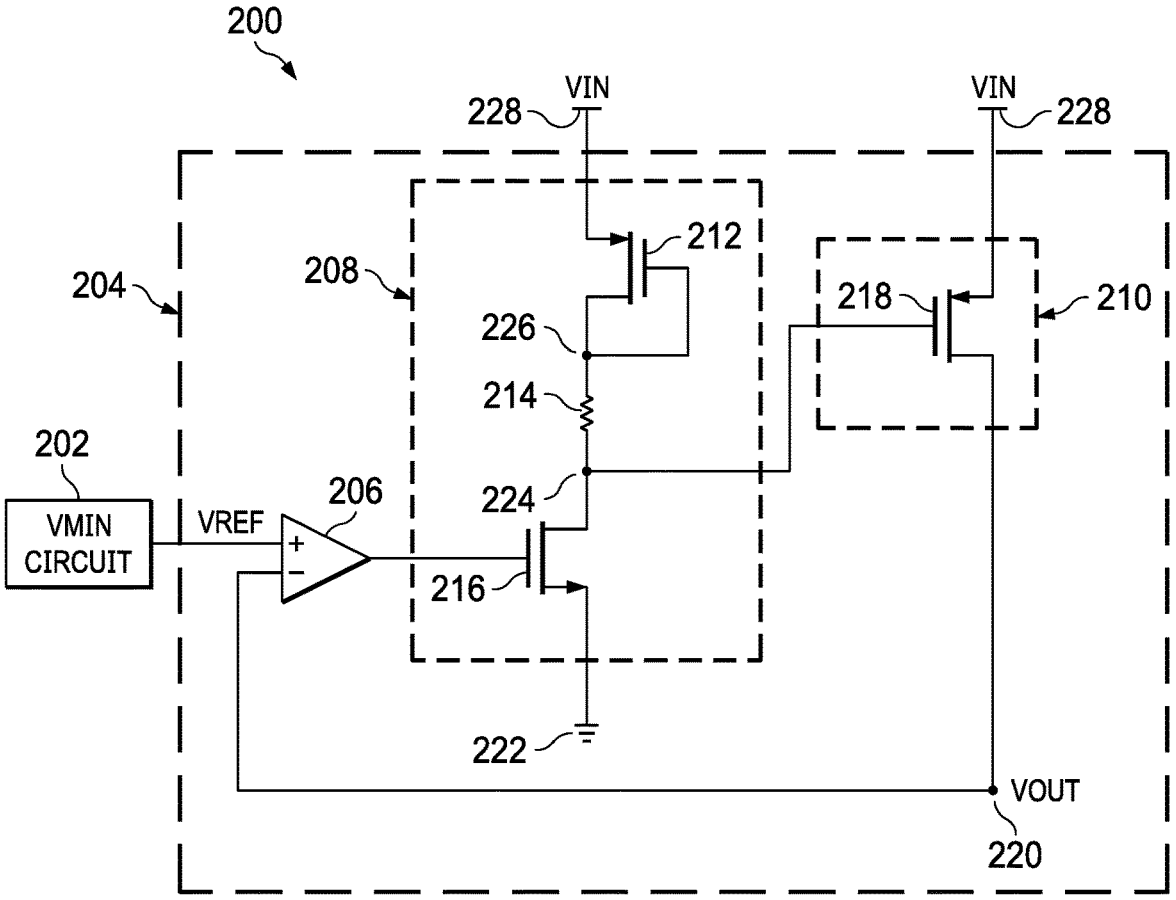
FIG. 2 shows a schematic diagram of an illustrative LDO in accordance with various examples.

Turning now to FIG. 2, a schematic diagram of an illustrative LDO 200 is shown. In at least some examples, the LDO 200 is suitable for implementation as the LDO 104 of the system 100 of FIG. 1. Accordingly, reference may be made in describing the LDO 200 to at least some components and/or signals of the system 100 of FIG. 1. In at least some examples, the LDO 200 includes a VMIN circuit 202 and a regulation circuit 204. In at least some examples, the VMIN circuit 202 is suitable for implementation as the VMIN circuit 108 of FIG. 1 and the regulation circuit 204 is suitable for implementation as the regulation circuit 110 of FIG. 1. The regulation circuit 204 includes an amplifier 206, a common-source (CS) circuit 208, and pass circuit 210. The amplifier 206 is, in at least some examples, an operational transconductance amplifier such that a magnitude of a difference in value of input signals received by the amplifier correlates to a current value of an output signal of the amplifier. The CS circuit 208, in at least some examples, includes a transistor 212, a resistor 214, and a transistor 216. The transistor 212 is, in some examples, a field effect transistor (FET) such as a p-type FET (pFET). The transistor 216 is, in some examples, a FET such as a n-type FET (nFET). The pass circuit 210, in at least some examples, includes a transistor 218. The transistor 218, in at least some examples, is a FET such as a pFET.

The VMIN circuit 202 is configured to receive VBG and VIN and generate VREF, as discussed in greater detail elsewhere herein. In at least one example, an output terminal of the VMIN circuit 202 is configured to couple to a first input terminal (e.g., a positive or non-inverting input terminal) of the amplifier 206. The amplifier 206 further has a second input terminal (e.g., a negative or inverting input terminal) coupled to a VOUT node 220. In at least some examples, the VOUT node 220 is a node at which the LDO 200 outputs VOUT and, in some examples, couples to a load such as the load 106. An output terminal of the amplifier 206 is coupled to a gate terminal of the transistor 216. A source terminal of the transistor 216 is coupled to a ground node 222 and a drain terminal of the transistor 216 is coupled to a node 224. The resistor 214 is coupled between the node 224 and a node 226. The transistor 212 has a gate terminal coupled to the node 226, a drain terminal coupled to the node 226, and a source terminal coupled to a VIN node 228 at which VIN is present. The transistor 218 has a gate terminal coupled to the node 224, a source terminal coupled to the VIN node 228, and a drain terminal coupled to the VOUT node 220.

In an example of operation of the LDO 200, based on a value of VREF as generated by the VMIN circuit 202, the regulation circuit 204 generates and outputs VOUT. For example, the transistor 216 is a common-source transistor that drives the transistor 212, which is configured as a diode-connected transistor. As VREF varies in value from VOUT by a greater magnitude, the amplifier 206 turns on the transistor 216 more strongly. Turning on the transistor 216 more strongly causes more current to flow through the CS circuit 208 between the VIN node 228 and the ground node 222. Because the current flowing through the CS circuit 208, and correspondingly the node 224, is increased, the transistor 218 is also turned on more strongly to increase current flow from the VIN node 228 to the VOUT node 220 to increase VOUT to reach VREF.

As discussed above, in the absence of the VMIN circuit 202 and teachings of the present disclosure, VIN can decrease in value to less than VREF and/or VOUT. This would cause the LDO 200 to enter dropout. When in dropout, the transistor 216 and the transistor 218 are each fully turned on such that a maximum supported current flows through each of the transistor 216 and the transistor 218. For example, the transistor 216 pulls a maximum supported current from the VIN node 228 in an attempt to more strongly turn on the transistor 218 to cause the transistor 218 to pull a maximum supported current from the VIN node 228 to increase a value of VOUT to match VREF. However, because VIN is less than VREF and VOUT while the LDO 200 is in dropout, no amount of current pulled by the transistor 216 and/or the transistor 218 will cause VOUT to match VREF. Despite this, both the transistor 216 and the transistor 218 continue pulling a maximum supported current. The current pulled by the transistor 216 is dropped across the resistor 214 and dissipated by the LDO 200 at least partially in the form of heat and/or other electromagnetic radiation. As the current being dissipated by the LDO 200 increases, efficiency of the LDO 200 decreases. When the maximum supported current is being dropped across the resistor 214, IQ of the LDO 200 increases substantially. This substantial increase in IQ can be detrimental and/or undesirable for the reasons stated elsewhere herein and can render the LDO 200 unsuitable for at least some application environments and/or use cases.

To prevent this substantial increase in IQ, as VIN drops in value, the VMIN circuit 202 decreases the value of VREF. For example, the VMIN circuit 202 decreases the value of VREF to maintain VREF at a value less than VIN. For example, the VMIN circuit 202 decreases the value of VREF to be approximately equal to VIN-VMIN. By maintaining VREF less than VMIN, the VMIN circuit 202 prevents the LDO 200 from entering dropout, thereby preventing the substantial increase in IQ of the LDO 200. For example, by maintaining decreasing the value of VREF to be less than VIN, the VMIN circuit 202 prevents the circumstance of a large, and unrecoverable, difference existing between VREF and VOUT. Preventing this large difference reduces a magnitude of an output of the amplifier 206, thereby reducing a strength with which the transistor 216 and the transistor 218 are turned on. Reducing the strength with which the transistor 216 is turned on, in turn, reduces current flow from the VIN node 228 to the ground node 222 through the CS circuit 208. Reducing current flow through the CS circuit 208 reduces current dropped across the resistor 214, thereby reducing IQ of the LDO 200.

Figure 3A:
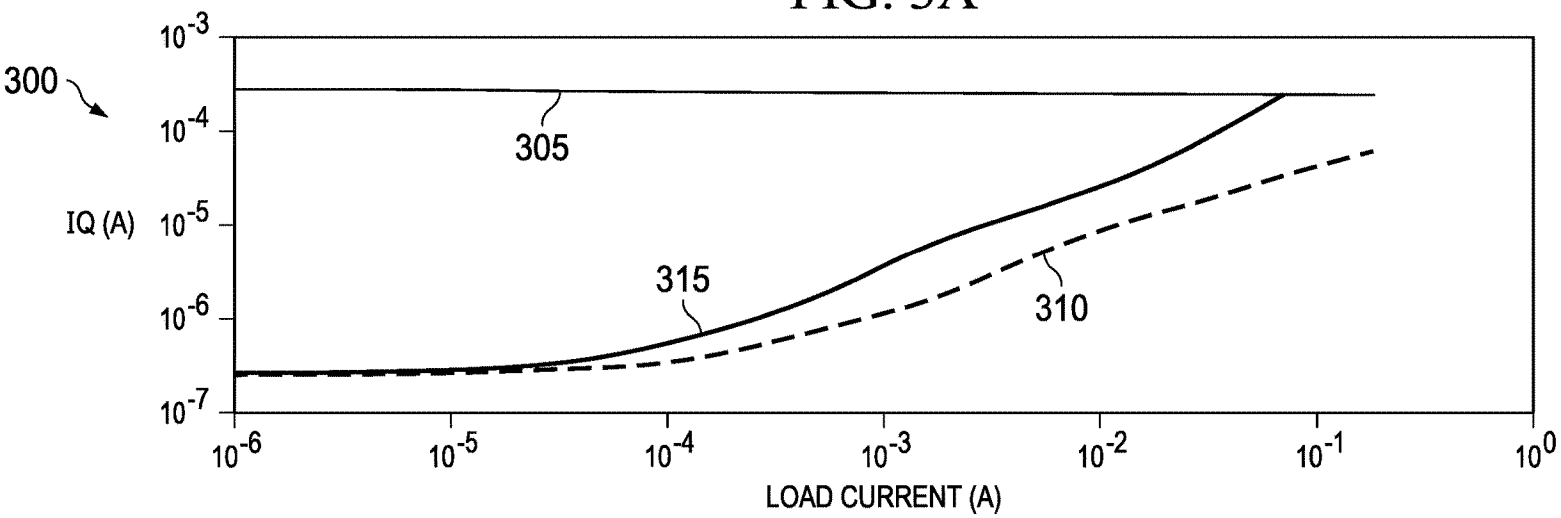
FIG. 3A shows a diagram of illustrative signal waveforms in accordance with various examples.
Figure 3B:
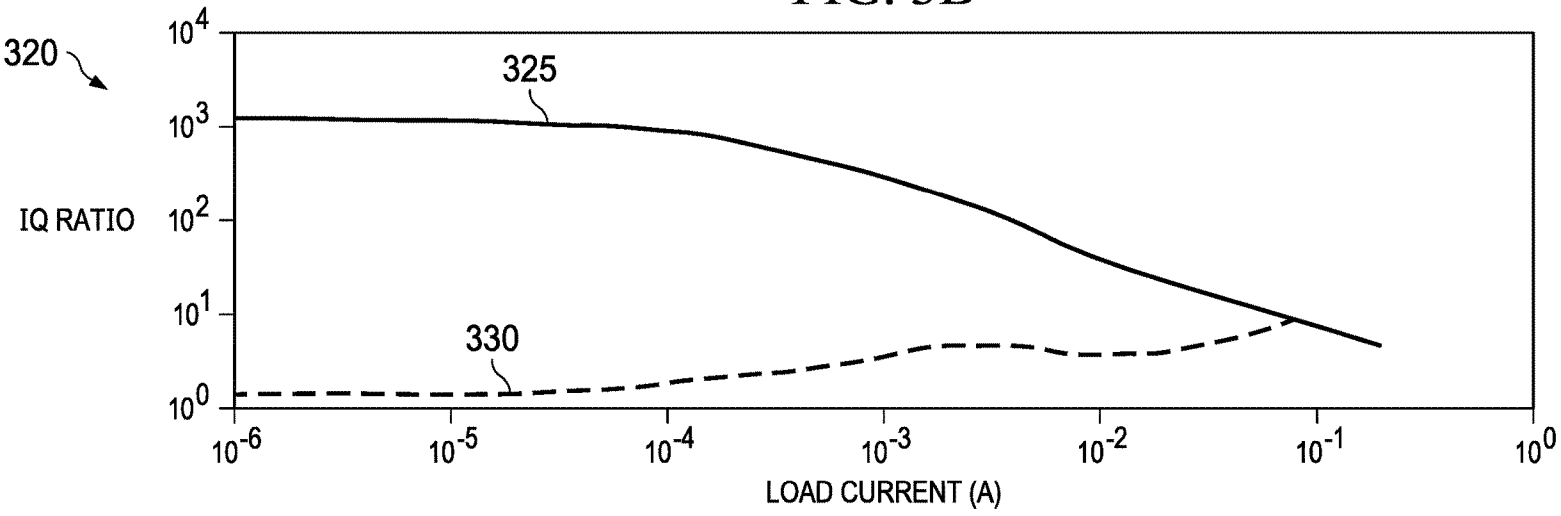
FIG. 3B shows a diagram of illustrative signal waveforms in accordance with various examples.

Turning now to FIGS. 3A and 3B, diagrams of illustrative signal waveforms in a LDO are shown. The diagram 300 and the diagram 320 are each illustrative of at least some signals that may be present in the system 100 of FIG. 1 and/or the LDO 200 of FIG. 2. Accordingly, reference may be made in describing the diagram 300 and the diagram 320 to at least some components and/or signals of the system 100 of FIG. 1 and/or the LDO 200 of FIG. 2.

Looking first at FIG. 3A, the diagram 300 illustrates a signal 305, a signal 310, and a signal 315. The signal 305 is representative of IQ in an LDO, such as the LDO 104 and/or the LDO 200, in the absence of the VMIN circuit, such as the VMIN circuit 108 or the VMIN circuit 202, respectively. The signal 310 is representative of IQ in an LDO that includes a VMIN circuit configured to maintain VREF approximately 50 millivolts (mV) less than VIN and in which VIN is less than VREF_TARGET. The signal 315 is representative of IQ in an LDO in which VIN is greater than the VREF_TARGET. Additionally, the vertical axis of the diagram 300 illustrates IQ of the LDO in units of amperes (A) and the horizontal axis of the diagram 300 illustrates a load current (e.g., current drawn by a load coupled to the LDO and receiving VOUT form the LDO) in units of A.

As shown by the signal 305, when the LDO enters dropout, IQ of the LDO is maintained approximately constant. As illustrated by comparing the signal 305 to the signal 315, IQ of the LDO during dropout is orders of magnitude greater than IQ of the LDO when not in dropout. In at least some examples, such as when the load current drawn from the LDO is small in value, IQ of the LDO during dropout is three orders of magnitude, or greater, more than IQ when not in dropout. In these circumstances, the LDO may consume more current in operation than the LDO delivers as load current, resulting in inefficiency of the LDO. However, as illustrated by the signal 310, when the LDO is prevented from entering dropout according to the teachings of the present disclosure, despite VIN falling below the VREF_TARGET, the IQ of the LDO is prevented from experiencing the substantial increase illustrated by the signal 305.

Looking next at FIG. 3B, the diagram 320 illustrates a signal 325 and a signal 330. The signal 325 is representative of a ratio of IQ of the LDO when operating in dropout to IQ of the LDO when not operating in dropout. The signal 330 is representative of a ratio of IQ of the LDO when VIN is less than the VREF_TARGET but VREF is reduced to remain less than VIN to IQ when VIN is greater than the VREF_TARGET. Additionally, the vertical axis of the diagram 320 illustrates the ratio of IQs of the LDO and the horizontal axis represents the load current in units of A. As shown by comparing the signal 325 to the signal 330, the dropout control of the present disclosure (e.g., as implemented by the VMIN circuit 108 and/or the VMIN circuit 202) reduces IQ of the LDO by orders of magnitude when VIN is less than the VREF_TARGET. As shown by signal 325 and the signal 330 at the left-hand side of the diagram 320, this reduction in IQ is particularly emphasized when the load current of the LDO is small in value.

Figure 4:
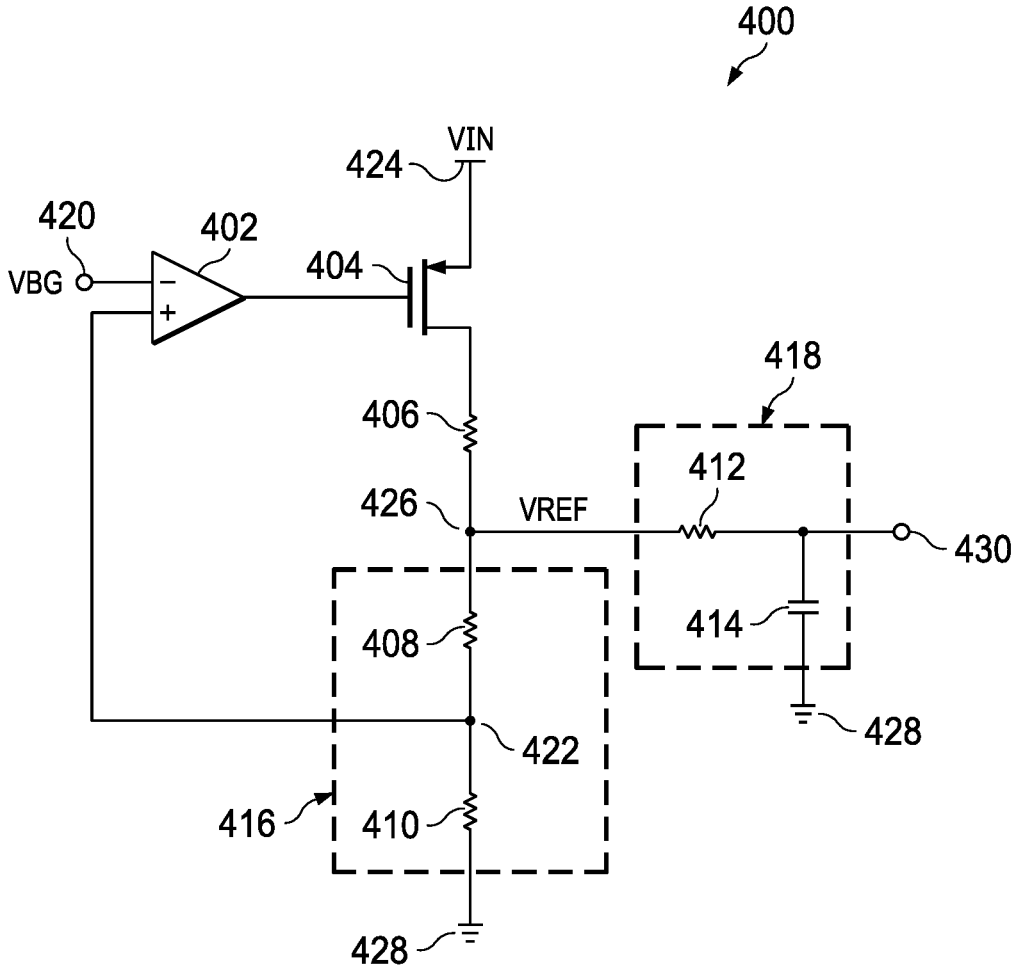
FIG. 4 shows a schematic diagram of an illustrative VMIN circuit in accordance with various examples.

Turning now to FIG. 4, a schematic diagram of an illustrative VMIN circuit 400 is shown. In at least some examples, the VMIN circuit 400 is suitable for implementation as the VMIN circuit 108 of the system 100 of FIG. 1 and/or the VMIN circuit 202 of the LDO 200 of FIG. 2. Accordingly, reference may be made in describing the VMIN circuit 400 to at least some components and/or signals of the system 100 of FIG. 1 and/or the LDO 200 of FIG. 2.

In at least some examples, the VMIN circuit 400 includes an amplifier 402, a pFET 404, a resistor 406, a resistor 408, a resistor 410, a resistor 412, and a capacitor 414. The resistor 408 and the resistor 410 together form a voltage divider 416. The resistor 412 and the capacitor 414 together form a filter 418. The amplifier 402 has a first input terminal (e.g., a negative or inverting input terminal) coupled to a node 420 and configured to receive VBG. The amplifier 402 further has a second input terminal (e.g., a positive or non-inverting input terminal) coupled to a node 422 and an output terminal coupled to a gate terminal of the pFET 404. The pFET 404 further has a source terminal coupled to a node 424 at which VIN is present and a drain terminal coupled through the resistor 406 to a node 426. The resistor 408 is coupled between the node 426 and the node 422 and the resistor 410 is coupled between the node 422 and a ground node 428. The resistor 412 is coupled between the node 426 and a node 430. The capacitor 414 is coupled between the node 430 and the ground node 428. In at least some examples, the VMIN circuit 400 is configured to couple at the node 430 to an input terminal of an amplifier configured to control a CS stage of an LDO. For example, in at least one implementation in which the VMIN circuit 400 is implemented as the VMIN circuit 202, the VMIN circuit 400 is configured to couple at the node 430 to the first input terminal of the amplifier 206. Accordingly, in at least some examples, the VMIN circuit 400 generates VREF at the node 426. VREF is subsequently provided in a filtered form at the node 430. However, in at least some examples the filter 418 is omitted such that the node 426 and the node 430 are instead shorted together and may be considered as being the same node.

In an example of operation of the VMIN circuit 400, the amplifier 402 drives and/or controls the pFET 404 according to a difference in value between VBG and a voltage present at the node 422 (V422). For example, in at least some implementations the amplifier 402 is a transconductance amplifier such that a magnitude of a difference in value of input signals received by the amplifier 402 correlates to a current value of an output signal of the amplifier 402. As a difference between VBG and V422 decreases, a current output by the amplifier 402 increases in value and the pFET 404 is driven or controlled less strongly until VGS of the pFET 404 is no longer sufficient to cause current to flow through the pFET 404. As a difference between VBG and V422 increases, the current sunk by the amplifier 402 increases in value and the pFET 404 is driven on or controlled more strongly until VGS of the pFET 404 is sufficiently high such that the voltage drop across the pFET 404 (e.g., drain to source voltage drop) is negligible compared to the voltage drop across resistor 406, setting the value of VMIN. The more strongly the pFET 404 is driven, in at least some examples, the more current that flows through the pFET 404 to generate the voltage drop across the pFET 404.

The amplifier 402 is configured such that it attempts to cause V422 to approximately equal VBG. Thus, when V422 is greater in value than VBG, the amplifier 402 outputs a signal having a current proportional to the difference between VBG and V422. This current charges a gate capacitor of the pFET 404, increasing a gate voltage of the pFET 404. When VGS of the pFET 404 decreases to be less than a threshold for turning on the pFET 404 (e.g., the gate voltage of the pFET 404 increases to be sufficiently close in value to VIN), the pFET 404 turns on and begins conducting current between its source and drain terminals. When VGS of the pFET 404 is less than, but still very near to (e.g., such as within 100 mV of), the threshold for turning on the pFET 404, the pFET 404 may be said to be driven weakly by the amplifier 402 or weakly turned-on, and the pFET 404 conducts a small amount of current. For the pFET 404, weakly turned-on, in at least one example, comprises operation in a saturation region of operation. This small amount of current flows to the node 426, and correspondingly at least partially to the node 422 through the resistor 408, increasing the value of V422. In at least some examples, when VIN is greater than VREF_TARGET, VREF of the VMIN circuit 400 is approximated by VBG*(R408+R410)/R410, where R408 is a resistance of the resistor 408 and R410 is a resistance of the resistor 410. Additionally, in the VMIN circuit 400, VREF_TARGET is approximated by VBG*(R408+R410)/R410. Because the pFET 404 is functioning as a constant current source when weakly driven by the amplifier 402, a voltage drop across the resistor 406 is nominal such that any effect of the resistor 406 on operation of the VMIN circuit 400 when VIN is greater than VREF_TARGET may be ignored.

As the value of V422 nears VBG, a current of the output of the amplifier 402 nears the value of V422/R410. When VIN is less than VREF_TARGET, this can eventually cause VGS of the pFET 404 to be greater than the threshold for turning on the pFET 404 and the pFET 404 will therefore turn on strongly. As VIN decreases in value, a strength with which the amplifier 402 drives the pFET 404 increases until the pFET 404 is fully or strongly tuned-on and operating as a switch. For the pFET 404, being fully or strongly turned-on, in at least one example, comprises operation in a triode region of operation. For other transistor types, such as bi-polar junction transistors (BJTs), being fully or strongly turned-on, in at least one example, comprises operation in a saturation region of operation. When fully turned-on, the pFET 404 approximates a short (with, in some examples, a voltage drop associated with a resistance of the pFET 404) between the node 424 and the resistor 406. In this example, VREF of the VMIN circuit 400 is approximated by VIN*(R408+R410)/(R408+R410+R406), where R406 is a resistance of the resistor 406. In at least one example when the pFET 404 is fully turned-on, the voltage drop across the resistor 406 defines VMIN. In at least some implementations, the VMIN circuit 400 realizes generation of VMIN without the dissipation of additional IQ, benefiting devices powered by a depletable power source. However, the VMIN circuit 400 maintains VMIN as a function of VIN, as opposed to a constant, to adjust to changes in VIN.

Figure 5:
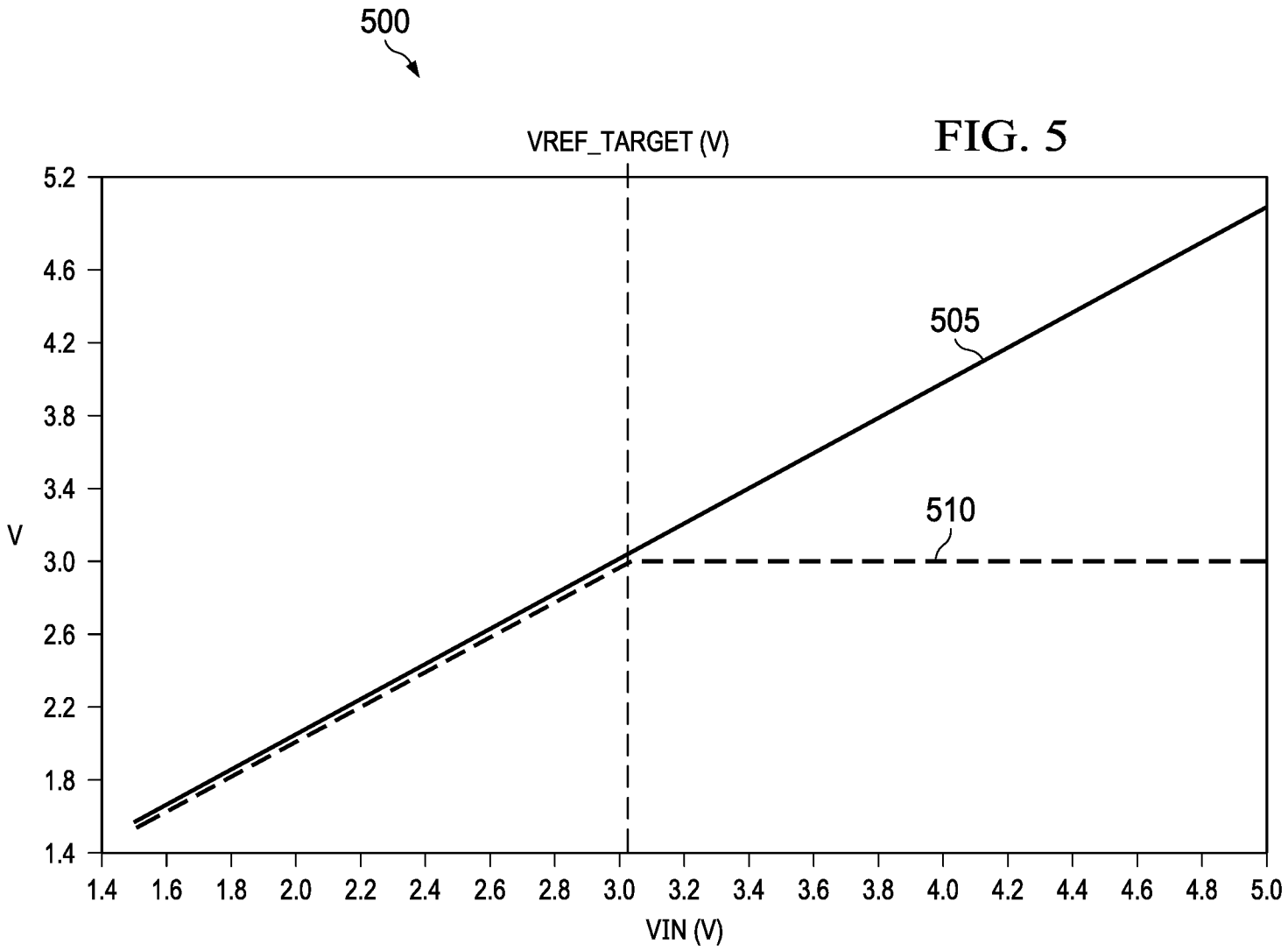
FIG. 5 shows a diagram of illustrative signal waveforms in accordance with various examples.

Turning now to FIG. 5, a diagram 500 of illustrative signal waveforms in a VMIN circuit is shown. The diagram 500 is illustrative of at least some signals that may be present in the VMIN circuit 400 of FIG. 4, which may itself be implemented in the LDO 200 of FIG. 2 and/or the system 100 of FIG. 1. Accordingly, reference may be made in describing the diagram 500 to at least some components and/or signals of the preceding figures of the present disclosure.

The diagram 500 illustrates a signal 505 and a signal 510. The signal 505 is representative of VIN in a VMIN circuit and the signal 510 is representative of VREF in the VMIN circuit. The vertical axis of the diagram 500 illustrates voltage in units of V and the horizontal axis of the diagram 500 illustrates VIN in units of V (such that the signal 505 is linear in the diagram 500, having a same y-axis and x-axis value at each point along the signal 505). As shown by the signal 505, when VIN is greater in value than the VREF_TARGET, VREF is maintained as a substantially constant value approximately equal to VREF_TARGET. However, and as shown by the signal 510, when VIN decreases in value to be less than VREF_TARGET, VREF correspondingly begins to decrease in value. VREF decreases in value, in at least some examples, linearly with VIN such that VREF is approximately equal to VIN minus VMIN when VIN is less than VREF_TARGET, as discussed in greater detail elsewhere herein. VREF is decreased in value, in at least some examples, by a VMIN circuit such as the VMIN circuit 400. In at least some examples, VREF decreasing in value to remain less than VIN when VIN is less than VREF_TARGET prevents a LDO of which VIN and VREF are signals from entering dropout. Preventing the LDO from entering dropout, in at least some examples, reduces IQ of the LDO compared to IQ of the LDO when operating in dropout.

Figure 6:
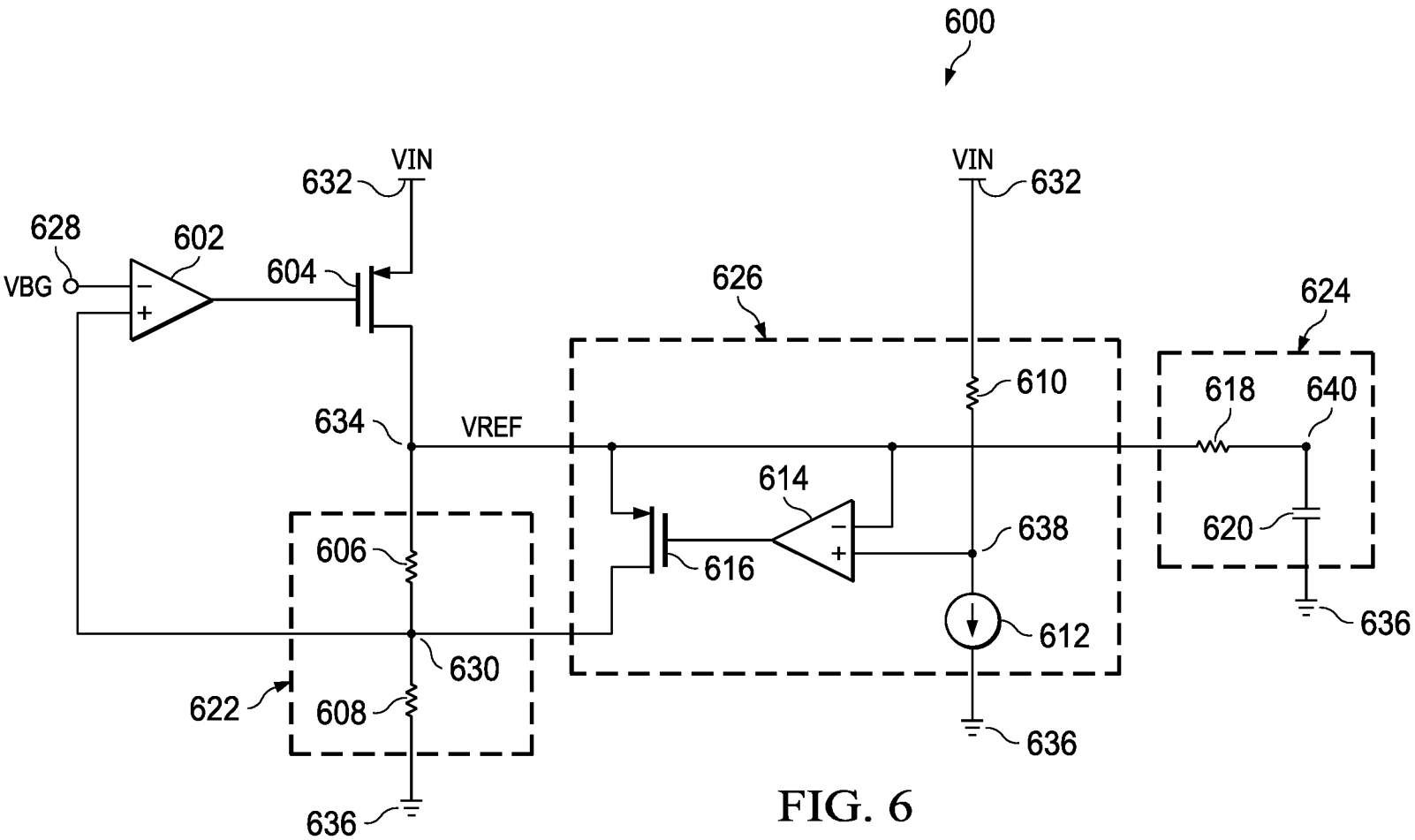
FIG. 6 shows a schematic diagram of an illustrative VMIN circuit in accordance with various examples.

Turning now to FIG. 6, a schematic diagram of an illustrative VMIN circuit 600 is shown. In at least some examples, the VMIN circuit 600 is suitable for implementation as the VMIN circuit 108 of the system 100 of FIG. 1 and/or the VMIN circuit 202 of the LDO 200 of FIG. 2. Accordingly, reference may be made in describing the VMIN circuit 600 to at least some components and/or signals of the system 100 of FIG. 1 and/or the LDO 200 of FIG. 2.

In at least some examples, the VMIN circuit 600 includes an amplifier 602, a pFET 604, a resistor 606, a resistor 608, a resistor 610, a current source 612, an amplifier 614, a pFET 616, a resistor 618, and a capacitor 620. The resistor 606 and the resistor 608 together form a voltage divider 622. The resistor 618 and the capacitor 620 together form a filter 624. The resistor 610, the current source 612, the amplifier 614, and the pFET 616 together form a control loop 626. The control loop is, for example, a VMIN control loop. The amplifier 602 has a first input terminal (e.g., a negative or inverting input terminal) coupled to a node 628 and configured to receive VBG. The amplifier 602 further has a second input terminal (e.g., a positive or non-inverting input terminal) coupled to a node 630 and an output terminal coupled to a gate terminal of the pFET 604. The pFET 604 further has a source terminal coupled to a node 632 at which VIN is present and a drain terminal coupled to a node 634. The resistor 606 is coupled between the node 634 and the node 630 and the resistor 608 is coupled between the node 630 and a ground node 636.

The resistor 610 is coupled between the node 632 and a node 638. The current source 612 is coupled between the node 638 and the ground node 636 and, in at least some examples, is configured to sink current from the node 638 to the ground node 636. The amplifier 614 has a first input terminal (e.g., a positive or non-inverting input terminal) coupled to the node 638, a second input terminal (e.g., a negative or inverting input terminal) coupled to the node 634, and an output terminal coupled to a gate terminal of the pFET 616. The pFET 616 has a source terminal coupled to the node 634 and a drain terminal coupled to the node 630. The resistor 618 is coupled between the node 634 and a node 640. The capacitor 620 is coupled between the node 640 and the ground node 636. In at least some examples, the VMIN circuit 600 is configured to couple at the node 640 to an input terminal of an amplifier configured to control a CS stage of an LDO. For example, in at least one implementation in which the VMIN circuit 600 is implemented as the VMIN circuit 202, the VMIN circuit 600 is configured to couple at the node 640 to the first input terminal of the amplifier 206. Accordingly, in at least some examples, the VMIN circuit 600 generates VREF at the node 634. VREF is subsequently provided in a filtered form at the node 640. However, in at least some examples the filter 624 is omitted such that the node 634 and the node 640 are instead shorted together and may be considered as being the same node.

In an example of operation of the VMIN circuit 600, the amplifier 602 drives and/or controls the pFET 604 according to a difference in value between VBG and a voltage present at the node 630 (V630). The amplifier 602 drives the pFET 604, with respect to VBG and V630, in at least some examples, in a manner substantially similar to that described above in reference to the amplifier 402 and the pFET 404 with respect to VBG and V422. Accordingly, for the sake of clarity and brevity, operation of the amplifier 602 and the pFET 604 is not reproduced here with respect to the VMIN circuit 600.

Similarly, in at least some examples, the amplifier 614 is a transconductance amplifier that drives the pFET 616 according to a difference in value between a voltage present at the node 638 (V638) and VREF. In at least some examples, the current source 612 sinks IB from the node 638, and correspondingly from the node 632 through the resistor 610. Accordingly, V638 is generated, in at least some examples, having a value of approximately VIN minus a product of IB multiplied by a resistance of the resistor 610. In at least some implementations of the VMIN circuit 600, the product of IB multiplied by the resistance of the resistor 610 is approximately equal to VMIN. When V638 is greater than VREF, the amplifier 614 outputs a signal having a current proportional to the difference between V638 and VREF. When VIN is greater than VREF_TARGET (and therefore greater than VREF), this difference can be large causing the current output by the amplifier 614 to maintain the pFET 616 in a turned-off state.

As VIN drops in value to become closer to VREF_TARGET (and therefore to VREF), the current output by the amplifier 614 decreases in value. As the current output by the amplifier 602 decreases in value, a voltage present at the gate terminal of the pFET 616 decreases. When VGS of the pFET 616 decreases to less than a threshold voltage for turning on the pFET 616, the pFET 616 turns on and begins conducting between its source and drain terminals. When the pFET 616 conducts current between its source and drain terminals, the pFET 616 shunts the resistor 606, providing a path for current to flow from the node 634 to the node 630 without flowing through the resistor 606. When V638 is approximately equal in value to VREF, the output current of the amplifier 614 is approximately zero, causing the pFET 616 to be fully turned-on. When the pFET 616 is fully turned-on, the pFET 616 at least partially shorts the resistor 606 such that a greater amount of current flows through the pFET 616 than flows through the resistor 606 and the amplifier 602 remains in regulation.

The amplifier 602 remaining in regulation, in at least some examples, comprises a gain of a control loop formed by the amplifier 602, the pFET 604, and the voltage divider 622 as greater than 0 decibels (dB). Conversely, being out of regulation (such as when dropout occurs in an LDO lacking the VMIN circuit 600), the pFET 604 operates in a fully turned-on mode. In this mode of operation, the amplifier 602 pulls the gate terminal of the pFET 604 as low as possible (e.g., close to a value present at the ground node 636). Changes to the node 630 (e.g., the feedback node) therefore have negligible impact on the control loop as the gate of the pFET 604 because the amplifier 602 has already reached its lowest possible output voltage. For example, such that changes on the inputs of amplifier 602 have little to no effect on the output of amplifier 602 such that there is little to no gain in the control loop. A consequence of out of regulation operation, in at least some examples, is the occurrence of undesirable noise at the node 634. In some examples, this noise could be from a clock circuit capacitively coupling the noise to the node 634 such that the noise cannot be rejected by the control loop. In at least some examples, the VMIN circuit 600 has an increased ability to reject noise than the VMIN circuit 400 of FIG. 4 because of the amplifier 602 remaining in regulation. However, maintaining the amplifier 602 in regulation, in at least some examples, comes at a cost of increased IQ of the VMIN circuit 600 when compared to an IQ of the VMIN circuit 400.

As discussed above, when the pFET 616 is fully turned-on, the pFET 616 at least partially shorts the resistor 606 such that a greater amount of current flows through the pFET 616 than flows through the resistor 606 and the amplifier 602 remains in regulation. Maintaining the amplifier 602 in regulation, in at least some examples, prevents overshoot in a value of VREF if VIN rapidly increases in value when VREF is being generated at least partially according to VIN (e.g., when VIN is less than VREF_TARGET). Thus, the VMIN circuit 600 regulates VREF to maintain VREF less than VIN minus VMIN. In at least one example of the VMIN circuit 600, VREF is defined as VMIN minus the magnitude of current conducted by the current source 612 times a resistance of the resistor 610. Maintaining VREF less than VIN minus VMIN, in at least some examples, prevents an LDO receiving VREF from entering dropout and experiencing a resultant, and sometimes undesirable, increase in IQ. In at least some examples, waveforms for VIN and VREF with respect to the VMIN circuit 600 are substantially similar to those as shown and described above with respect to FIG. 5.

Figure 7A:
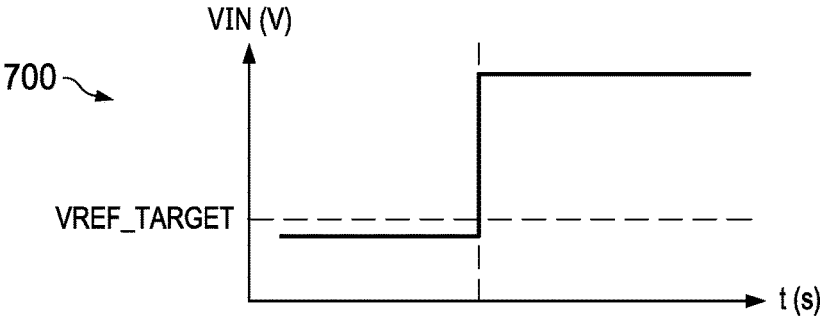
FIG. 7A shows a diagram of illustrative signal waveforms in accordance with various examples.
Figure 7B:
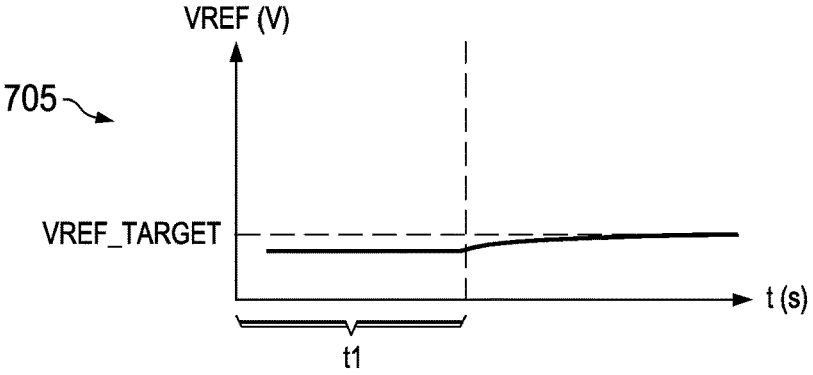
FIG. 7B shows a diagram of illustrative signal waveforms in accordance with various examples.

Turning now to FIGS. 7A and 7B, diagrams of illustrative signal waveforms in a VMIN circuit are shown. The diagram 700 of FIG. 7A and diagram 705 of FIG. 7B are illustrative of at least some signals that may be present in the VMIN circuit 600 of FIG. 6, which may itself be implemented in the LDO 200 of FIG. 2 and/or the system 100 of FIG. 1. Accordingly, reference may be made in describing the diagram 700 and the diagram 705 to at least some components and/or signals of the preceding figures of the present disclosure.

Diagram 700 is a graph of VIN versus time. VIN is illustrated on the y-axis in units of V and time is illustrated on the x-axis in units of seconds (s). As shown by the diagram 700 and the diagram 705, during the time period t1 VIN is less than VREF_TARGET and VREF is correspondingly less than VREF_TARGET (e.g., approximately equal to VIN-VMIN). However, at the end of t1, VIN rapidly increases in value to be greater than VREF. Despite this rapid increase in VIN, VREF does not rapidly increase in value and instead smoothly increases in value to approximately equal VREF_TARGET. In at least some LDO architectures lacking the VMIN circuit of the present disclosure, an amplifier may be out of regulation and VREF may overshoot VREF_TARGET at the end of t1. However, at least some examples of the VMIN circuit of the present disclosure remain in regulation and prevent such an overshoot, potentially preventing unintentional and/or undesirable operation of a device that includes the VMIN circuit of the present disclosure.

Figure 8:
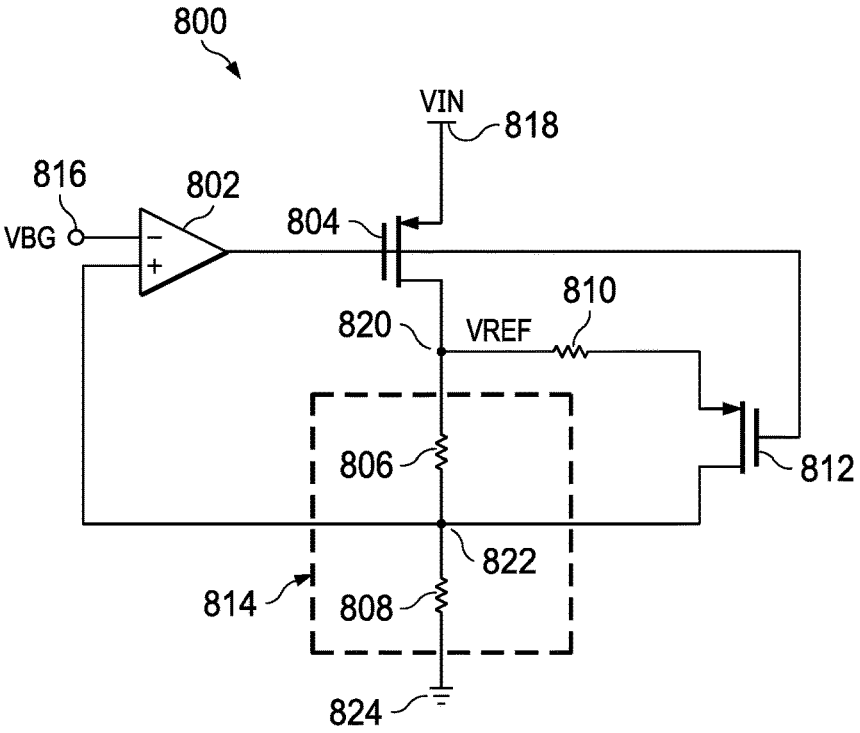
FIG. 8 shows a schematic diagram of an illustrative VMIN circuit in accordance with various examples.

Turning now to FIG. 8, a schematic diagram of an illustrative VMIN circuit 800 is shown. In at least some examples, the VMIN circuit 800 is suitable for implementation as the VMIN circuit 108 of the system 100 of FIG. 1 and/or the VMIN circuit 202 of the LDO 200 of FIG. 2. Accordingly, reference may be made in describing the VMIN circuit 800 to at least some components and/or signals of the system 100 of FIG. 1 and/or the LDO 200 of FIG. 2.

In at least some examples, the VMIN circuit 800 includes an amplifier 802, a pFET 804, a resistor 806, a resistor 808, a resistor 810, and a pFET 812. The resistor 806 and the resistor 808 together form a voltage divider 814. The amplifier 802 has a first input terminal (e.g., a negative or inverting input terminal positive or non-inverting input terminal) coupled to a node 816 and configured to receive VBG. The amplifier 802 further has a second input terminal (e.g., a positive or non-inverting input terminal) coupled to a node 822 and an output terminal coupled to a gate terminal of the pFET 804. The pFET 804 further has a source terminal coupled to a node 818 at which VIN is present and a drain terminal coupled to a node 820. The resistor 806 is coupled between the node 820 and the node 822 and the resistor 808 is coupled between the node 822 and a ground node 824. The pFET 812 has a gate terminal coupled to the output terminal of the amplifier 802, a source terminal coupled through the resistor 810 to the node 820, and a drain terminal coupled to the node 822. In at least some examples of the VMIN circuit 800, VREF is the voltage present at the node 820.

In an example of operation of the VMIN circuit 800, the amplifier 802 drives and/or controls the pFET 804 according to a difference in value between VBG and a voltage present at the node 822 (V822). The amplifier 802 drives the pFET 804 and the pFET 812 with respect to VBG and V822, in at least some examples, in a manner substantially similar to that described above in reference to the amplifier 402 and the pFET 404 with respect to VBG and V422. Accordingly, for the sake of clarity and brevity, operation of the amplifier 802, the pFET 804, and the pFET 812 is not reproduced here with respect to the VMIN circuit 800.

In at least some examples, the pFET 804 has a greater threshold voltage for turning on than does the pFET 812. For example, in at least one example, a difference in threshold voltages for turning on the pFET 804 and the pFET 812 is approximately 250 mV. Accordingly, in at least some implementations the pFET 804 may be turned-off, or may be turned on but weakly conducting, when the pFET 812 is turned-on and/or strongly conducting, despite the pFET 804 and the pFET 812 both being controlled by an output of the amplifier 802. When the pFET 812 turns on and begins conducting, the resistor 810 and the pFET 812 shunt the resistor 806 providing a path for current to flow from the node 820 to the node 822 without flowing through the resistor 806. When the pFET 812 is turned-on, the pFET 812 shorts the resistor 806 such that substantially no current flows through the resistor 806 and the amplifier 802 remains in regulation. In this example, current flows through the resistor 810 and the pFET 812 instead of the resistor 806, assuming that a resistance of the resistor 810 is substantially less than a resistance of the resistor 806. Alternatively, when the pFET 812 is fully turned-on, the pFET 812 at least partially shorts the resistor 806 such that a greater amount of current flows through the resistor 810 and the pFET 812 than flows through the resistor 806 and the amplifier 802 again remains in regulation. In at least some examples, waveforms for VIN and VREF with respect to the VMIN circuit 800 are substantially similar to those as shown and described above with respect to FIG. 5.

In the foregoing discussion, the terms "including" and "comprising" are used in an open-ended fashion, and thus should be interpreted to mean "including, but not limited to . . . ." The term "couple" is used throughout the specification. The term may cover connections, communications, or signal paths that enable a functional relationship consistent with the description of the present disclosure. For example, if device A generates a signal to control device B to perform an action, in a first example device A is coupled to device B, or in a second example device A is coupled to device B through intervening component C if intervening component C does not substantially alter the functional relationship between device A and device B such that device B is controlled by device A via the control signal generated by device A. A device that is "configured to" perform a task or function may be configured (e.g., programmed and/or hardwired) at a time of manufacturing by a manufacturer to perform the function and/or may be configurable (or reconfigurable) by a user after manufacturing to perform the function and/or other additional or alternative functions. The configuring may be through firmware and/or software programming of the device, through a construction and/or layout of hardware components and interconnections of the device, or a combination thereof. Furthermore, a circuit or device that is said to include certain components may instead be configured to couple to those components to form the described circuitry or device. For example, a structure described as including one or more semiconductor elements (such as transistors), one or more passive elements (such as resistors, capacitors, and/or inductors), and/or one or more sources (such as voltage and/or current sources) may instead include only the semiconductor elements within a single physical device (e.g., a semiconductor die and/or integrated circuit (IC) package) and may be configured to couple to at least some of the passive elements and/or the sources to form the described structure either at a time of manufacture or after a time of manufacture, for example, by an end-user and/or a third-party.

While certain components are described herein as being of a particular process technology (e.g., FET, metal oxide semiconductor FET (MOSFET), n-type, p-type, etc.), these components may be exchanged for components of other process technologies (e.g., replace FET and/or MOSFET with bi-polar junction transistor (BJT), replace n-type with p-type or vice versa, etc.) and reconfiguring circuits including the replaced components to provide desired functionality at least partially similar to functionality available prior to the component replacement. Components illustrated as resistors, unless otherwise stated, are generally representative of any one or more elements coupled in series and/or parallel to provide an amount of impedance represented by the illustrated resistor. Additionally, uses of the phrase "ground voltage potential" in the foregoing discussion are intended to include a chassis ground, an Earth ground, a floating ground, a virtual ground, a digital ground, a common ground, and/or any other form of ground connection applicable to, or suitable for, the teachings of the present disclosure. Unless otherwise stated, "about", "approximately", or "substantially" preceding a value means+/−10 percent of the stated value.

The above discussion is meant to be illustrative of the principles and various examples of the present disclosure. Numerous variations and modifications will become apparent to those skilled in the art once the above disclosure is fully appreciated. It is intended that the present disclosure be interpreted to embrace all such variations and modifications.

What is claimed is:

1. A circuit, comprising:

a first amplifier comprising a first input terminal configured to receive a first voltage signal, a second input terminal coupled to a first node, and an output terminal;

a voltage divider coupled between a second node and a ground node and having the first node as an output node of the voltage divider;

a first resistor coupled at a first end to the second node;

a transistor comprising a gate terminal coupled to the output terminal of the first amplifier, the transistor being coupled between an input voltage node and a second end of the first resistor;

a second amplifier comprising a first input terminal coupled to the second node, a second input terminal coupled to a low dropout regulator (LDO) output node, and an output terminal;

a LDO common-source (CS) circuit coupled to the input voltage node and the output terminal of the second amplifier and having an output terminal; and a LDO pass circuit coupled to the input voltage node and the output terminal of the LDO CS circuit.

2. The circuit of claim 1, wherein the transistor comprises a source terminal coupled to the input voltage node and a drain terminal coupled to the second end of the first resistor.

3. The circuit of claim 1, further comprising a filter coupled to the second node.

4. The circuit of claim 1, wherein the first amplifier and the transistor are configured to generate a second voltage signal at the second node according to a value of the first voltage signal and resistances of components of the voltage divider when an input voltage present at the input voltage node exceeds a threshold.

5. The circuit of claim 1, wherein the first amplifier and the transistor are configured to generate a third voltage signal at the second node according to a value of an input voltage present at the input voltage node, resistances of components of the voltage divider, and a resistance of the first resistor when the input voltage present at the input voltage node is less than a threshold.

6. The circuit of claim 5, wherein the first amplifier and the transistor are configured to generate the third voltage signal such that the third voltage signal remains less in value than the input voltage by an amount proportional to the resistance of the first resistor.

7. The circuit of claim 1, wherein the second amplifier controls the LDO CS circuit to control the LDO pass circuit to generate a fourth voltage signal at the LDO output node approximately equal in value to a signal present at the second node, and wherein the first amplifier and the transistor are configured to prevent the LDO CS circuit from entering dropout.

8. A circuit, comprising:

a low dropout regulator (LDO) comprising a first input terminal configured to receive a reference voltage, a second input terminal coupled to an input voltage node and configured to receive an input voltage signal; and an output node; and a minimum dropout voltage circuit comprising a first input terminal configured to receive a first voltage signal, a second input terminal coupled to the input voltage node, and an output terminal coupled to the second input terminal of the LDO;

wherein the minimum dropout voltage circuit further comprises:

a first amplifier comprising a first input terminal configured to receive a first voltage signal, a second input terminal coupled to a first node, and an output terminal;

a first transistor comprising a gate terminal coupled to the output terminal of the first amplifier, the transistor being coupled between an input voltage node and the output terminal of the minimum dropout voltage circuit;

a voltage divider coupled between the output terminal of the minimum dropout voltage circuit and a ground node and having the first node as an output node of the voltage divider; and a second transistor coupled between the output terminal of the minimum dropout voltage circuit and the first node.

9. The circuit of claim 8, wherein the minimum dropout voltage circuit further comprises:

a first amplifier comprising a first input terminal configured to receive a first voltage signal, a second input terminal coupled to a first node, and an output terminal;

a voltage divider coupled between the output terminal of the minimum dropout voltage circuit and a ground node and having the first node as an output node of the voltage divider;

a first resistor coupled at a first end to the output terminal of the minimum dropout voltage circuit; and a transistor comprising a gate terminal coupled to the output terminal of the first amplifier, the transistor being coupled between an input voltage node and a second end of the first resistor.

10. The circuit of claim 9, wherein the first amplifier and the transistor are configured to prevent the LDO from entering dropout by maintaining the value of the reference voltage less than the value of the input voltage signal by the minimum dropout voltage by generating the reference voltage according to the value of the input voltage signal, resistances of components of the voltage divider, and a resistance of the first resistor when the input voltage signal is less than a threshold determined according to the first voltage signal and a ratio of the resistances of the components of the voltage divider, and wherein the minimum dropout voltage is proportional to the resistance of the first resistor.

11. The circuit of claim 8, wherein the second transistor comprises a gate terminal coupled to the output terminal of the first amplifier, a drain terminal coupled to the first node, and a source terminal, and wherein the minimum dropout voltage circuit further comprises a resistor coupled between the source terminal of the second transistor and the output terminal of the minimum dropout voltage circuit.

12. The circuit of claim 11, wherein the first amplifier and the second transistor are configured to prevent the LDO from entering dropout by maintaining the value of the reference voltage less than the value of the input voltage signal by the minimum dropout voltage by shunting a top resistor of the voltage divider to maintain the first amplifier in regulation and generate the reference voltage when the input voltage signal is less than a threshold determined according to the first voltage signal and a ratio of resistances of components of the voltage divider, and wherein the minimum dropout voltage is a magnitude of a drain to source voltage of the first transistor.

13. The circuit of claim 8, wherein the second transistor comprises a gate terminal, a source terminal coupled to the output terminal of the minimum dropout voltage circuit, and a drain terminal coupled to the first node, and wherein the minimum dropout voltage circuit further comprises:

a second amplifier comprising a first input terminal coupled to a second node, a second input terminal coupled to the output terminal of the minimum dropout voltage circuit, and an output terminal coupled to the gate terminal of the second transistor;

a resistor coupled between the input voltage node and the second node; and a current source coupled between the second node and the ground node.

14. The circuit of claim 13, wherein the second amplifier and the second transistor are configured to prevent the LDO from entering dropout by maintaining the value of the reference voltage less than the value of the input voltage signal by the minimum dropout voltage by shunting a top resistor of the voltage divider to maintain the first amplifier in regulation and generate the reference voltage when the input voltage signal is less than a threshold determined according to the first voltage signal and a ratio of resistances of components of the voltage divider, and wherein the minimum dropout voltage is a voltage drop across the first resistor determined according to the resistance of the first resistor and a current conducted by the current source.

15. A system, comprising:

a low dropout regulator (LDO) comprising a first input terminal configured to receive a reference voltage, a second input terminal coupled to an input voltage node and configured to receive an input voltage signal; and an output node;

a sensor coupled to the output node and configured to receive regulated power from the output node; and a minimum dropout voltage circuit comprising a first input terminal configured to receive a first voltage signal, a second input terminal coupled to the input voltage node, and an output terminal coupled to the second input terminal of the LDO, wherein the minimum dropout voltage circuit is configured to prevent the LDO from entering dropout by:

maintaining a value of the reference voltage less than a value of the input voltage signal by a minimum dropout voltage;

generating the reference voltage according to a value of the first voltage signal when the value of the input voltage signal exceeds a threshold; and generating the reference voltage according to the value of the input voltage signal and the minimum dropout voltage when the value of the input voltage signal is less than the threshold, and wherein generating the reference voltage according to the value of the input voltage signal and the minimum dropout voltage when the value of the input voltage signal is less than the threshold reduces a quiescent current of the LDO by multiple orders of magnitude when the LDO is operating under light load conditions.

16. The system of claim 15, wherein in generating the reference voltage according to the value of the input voltage signal and the minimum dropout voltage when the value of the input voltage signal is less than the threshold, an amplifier of the minimum dropout voltage circuit remains in regulation, thus preventing overshoot of the reference voltage beyond the threshold when an increase in the value of the input voltage signal of 1 volt per microsecond or greater occurs.

* * * * *